US005478213A

United States Patent [19]

Harris et al.

[11] Patent Number: 5,478,213

[45] Date of Patent: Dec. 26, 1995

[54] FUEL INJECTION PUMP

[75] Inventors: Kenneth M. Harris, Maidstone; Derek W. Tomsett, Rye, both of United Kingdom

[73] Assignee: Lucas Industries Public Limited Company, Solihull, England

[21] Appl. No.: 204,209

[22] PCT Filed: Aug. 28, 1992

[86] PCT No.: PCT/GB92/01572

§ 371 Date: Mar. 7, 1994

§ 102(e) Date: Mar. 7, 1994

[87] PCT Pub. No.: WO93/06361

PCT Pub. Date: Apr. 1, 1993

[30] Foreign Application Priority Data

Sep. 13, 1991 [GB] United Kingdom ..... 9119690

[51] Int. Cl.[6] ..... F04B 49/00; F04B 53/10

[52] U.S. Cl. ..... 417/308; 417/490; 417/434; 417/440; 417/504; 123/506

[58] Field of Search ..... 417/308, 490, 417/434, 440, 504; 123/506, 447

[56] References Cited

U.S. PATENT DOCUMENTS

| | | | |
|---|---|---|---|
| 839,331 | 12/1906 | Stevens | 417/504 |
| 2,575,955 | 11/1951 | Hatch | 417/308 |
| 4,497,345 | 3/1991 | Dahlmann | 123/506 |
| 4,936,755 | 6/1990 | Greeves et al. . | |
| 5,027,776 | 7/1991 | Nicol . | |
| 5,044,899 | 9/1991 | Nicol | 417/440 |
| 5,119,786 | 6/1992 | Collingborn et al. . | |

FOREIGN PATENT DOCUMENTS

| | | | |
|---|---|---|---|
| 0283136 | 9/1988 | European Pat. Off. . | |
| 0413453 | 2/1991 | European Pat. Off. . | |
| 0458529 | 11/1991 | European Pat. Off. . | |
| 0936427 | 11/1955 | Germany | 417/308 |

*Primary Examiner*—Richard A. Bertsch
*Assistant Examiner*—Ted Kim
*Attorney, Agent, or Firm*—Jacobson, Price, Holman & Stern

[57] ABSTRACT

A fuel injection pumping apparatus has a cam (9) actuated reciprocable plunger (13) housed in a bore (11) into which fuel flows from a fuel supply (7,14). An outlet (12) extends from a pumping chamber (13A) defined by the plunger and bore. A spill passage (19) communicates the pumping chamber with a spill valve (16) so that fuel from the pumping chamber which flows through the passage and spill valve (20) flows into a cylinder (21) containing a resiliently biased piston (17). The fuel which flows into the cylinder is returned to the pumping chamber during outward movement of the plunger and the fuel supply (14,7) ensures that the pumping chamber is completely filled with fuel. A safety valve (30,31) allows fuel to escape from the cylinder (21) in the event that the piston (17) sticks in the cylinder.

10 Claims, 2 Drawing Sheets

FUEL INJECTION PUMP

BACKGROUND OF THE INVENTION

This invention relates to a fuel injection pumping apparatus for supplying fuel to internal combustion engines.

Examples of such apparatus are shown in Eurpean patent documents EP-A-0343759 (corresponding to U.S. Pat. No. 4,936,755) and EP-A-0423958 (corresponding to U.S. Pat. No. 5,119,786). In such apparatus the maximum stroke of the piston is limited and is arranged to be at least just sufficient to absorb the total volume of fuel which can be displaced by the pumping plunger during its inward stroke. If in such apparatus the piston should seize within its cylinder or if the resilient biasing of the piston should fail then in the former case, the piston will be unable to move to absorb the spilled fuel and in the latter case if the piston is not already at the limit of its stroke, it will very quickly assume its limiting position. In both cases therefore irrespective of the operation of the spill valve the total volume of fuel displaced by the pumping plunger will be delivered to the associated engine. The increase in fuel flow to the engine will result in uncontrolled acceleration of the engine and the vehicle which is driven by the engine.

BRIEF SUMMARY OF THE INVENTION

The object of the present invention is to provide an apparatus of the kind specified above in which the aforesaid risk is minimized.

According to the invention in an apparatus of the kind specified safety valve means is provided to allow escape of fuel from the cylinder in the event that the fuel pressure in the cylinder increases to a value which exceeds the pressure required to move the piston against the action of its resilient loading but is less than that required to displace fuel through the outlet.

The apparatus of the invention includes a pumping plunger mounted in a bore, the plunger and the bore defining a pumping chamber, a cam operable to effect inward movement of the plunger to displace fuel from the pumping chamber, an outlet from the pumping chamber through which fuel displaced from the pumping chamber can flow to an associated engine, fuel supply means for completely filling the pumping chamber with fuel prior to inward movement of the plunger by the cam, a spill valve operable to spill fuel from the pumping chamber thereby to control the flow of fuel through the outlet, an accumulator cylinder into which the fuel which flows through the valve flows and a resiliently biased piston in the cylinder, the piston being displaced by the spilled fuel flowing into the cylinder and acting to return the spilled fuel to the pumping chamber before the next inward stroke of the pumping plunger.

BRIEF DESCRIPTION OF THE DRAWING

An example of an apparatus in accordance with the invention will now be described with reference to the accompanying diagrammatic drawings wherein.

DETAILED DESCRIPTION OF THE DRAWING

Figure 1:
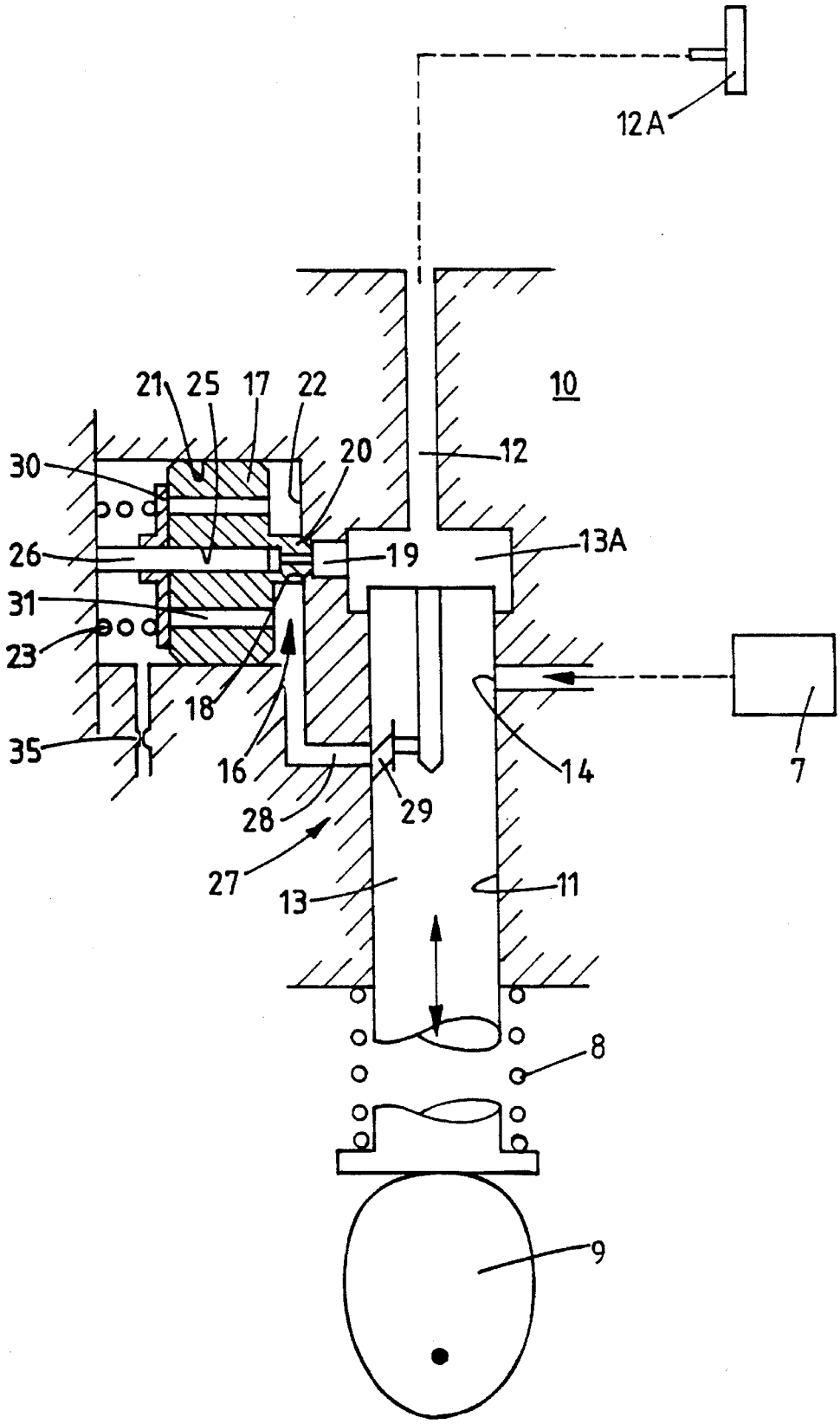
FIG. 1 is a cross-sectional view of a preferred embodiment of the invention.

Referring to the drawing the apparatus comprises a body 10 in which is formed a bore 11. Extending from one end of the bore 11 is an outlet 12 which in use is connected to a fuel injection nozzle 12A of an associated engine.

Slidable in the bore is a pumping plunger 13 and the inner end of the plunger 13 together with the inner end of the bore define a pumping chamber 13A from which the outlet 12 extends.

The plunger is movable inwardly by an engine driven cam 9 and is movable outwardly by means of a spring 8. During the outward movement of the pumping plunger a port 14 formed in the wall of the bore 11 is uncovered by the inner end of the plunger and the port 14 is connected to a source 7 of fuel under pressure so that the pumping chamber 13A is completely filled with fuel prior to the inward movement of the plunger by the cam.

In order to control the quantity of fuel which is supplied through the outlet 12 to the associated engine a spill valve generally indicated at 16 is provided comprising a valve member 20 engagable with a seating 18 which is located about a spill passage 19 extending from the pumping chamber 13A. The spill valve member 20 is conveniently formed as a projection of a piston 17 which is slidable within a cylinder 21 in the end wall 22 of which is formed the spill port 19. The piston is biased by resilient means in the form of a coiled compression spring 23 so that the valve member 20 engages with the seating 18.

Conveniently the valve member in the closed position is arranged to be substantially pressure balanced and this is achieved by the provision of a bore 25 in the piston, the inner end of the bore being in communication with the spill port 19 and the bore being occupied by a plunger 26. The end area of the plunger and the area of the bore 25 are slightly less than the end area of the valve member 20 which is exposed in the closed position of the valve member to the spill port 19.

The operation of the spill valve is controlled by valve means in the form of a spill control valve 27 which comprises a port 28 opening into the bore 11 and a helical groove 29 on the periphery of the plunger, the groove communicating by way of a passage or groove with the pumping chamber 13A. The plunger is movable angularly within the body 10 in known manner. In operation, during inward movement of the plunger as soon as the port 14 is covered, fuel will be displaced from the pumping chamber through the outlet 12. This displacement of fuel will continue until the Groove 29 is brought into register with the port 28 whereupon fuel at the high pressure within the pumping chamber will be admitted to the cylinder 21 to act on the piston thereby to lift the valve member 20 from its seating to allow the remaining fuel displaced from the pumping chamber 13A to flow into the cylinder 21 along the spill passage 19. The position at which the groove 29 is brought into register with the port 28 depends upon the angular setting of the plunger and this enables the quantity of fuel supplied to the associated engine to be varied. When the plunger is moved downwardly by the spring 8, the piston 17 under the action of its spring 23 will force the displaced fuel back into the pumping chamber 13A until the valve member engages the seating. The end of the cylinder containing the spring 23 is vented by way of a restrictor 35 and the purpose of this restrictor is to limit the rate of movement of the piston and therefore the rate at which fuel can be spilled.

The maximum displacement of the piston is slightly more than the maximum displacement of the pumping plunger so that it is possible to arrange that no fuel is supplied to the associated engine.

If the piston should stick in its maximum displaced position, the fuel which has flowed into the cylinder 21 will not be returned to the pumping chamber however, the pumping chamber will be completely filled with fuel by way of the inlet port 14, and during the next inward stroke of the pumping plunger no fuel will be able to flow through the spill passage 19 so that all the fuel displaced by the plunger 13 will flow to the associated engine. In order to minimize this risk, there is provided a safety valve and this comprises a plate like valve element 30 which is biased into engagement with the end of the piston remote from the valve member conveniently by the spring 23. The valve element closes the adjacent ends of a plurality of passages 31 which extend axially within the piston and it is arranged that the valve element will be lifted away from the piston to permit flow of fuel through the passages 31 when the fuel pressure rises above that which is required to effect normal movement of the piston but below the pressure required to open the valve in the fuel injection nozzle 12A which is connected to the outlet 12. If therefore the piston 17 is stuck, the plate valve element 30 will be lifted from the piston to allow spillage of fuel so that no fuel will be supplied to the associated engine. In the particular example, even if the piston sticks with the spill valve member 20 in engagement with the seating 18, some spillage of fuel will occur as soon as the groove 29 opens to the port 28. It is emphasized however that the dimensions of the port 28 and the groove 29 are such that in normal operations most of the fuel spilled will flow through the spill port 19.

Figure 2:
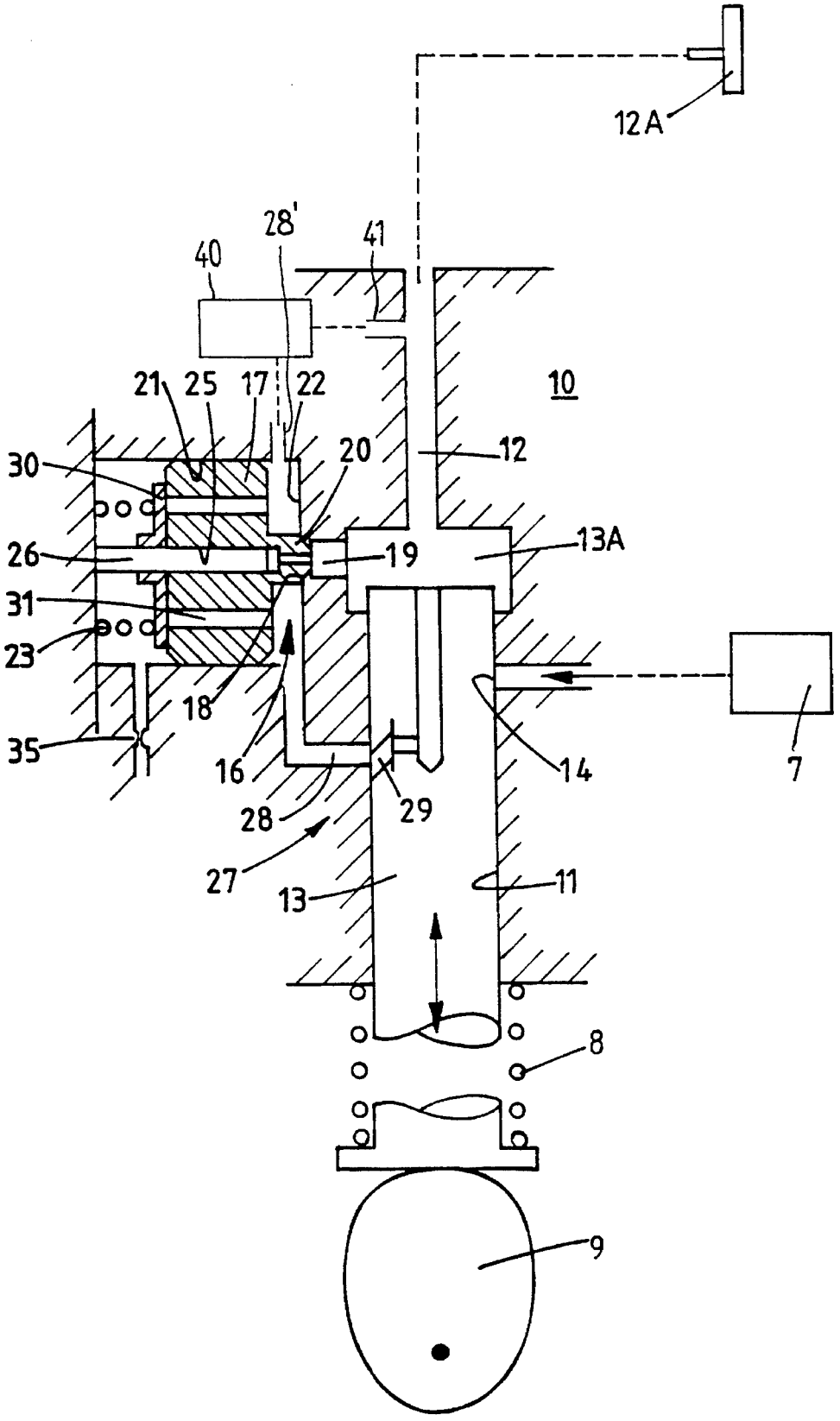
FIG. 2 is a view similar to FIG. 1 of a second embodiment of the invention.

The arrangement as described is equally applicable to a rotary distributor type of fuel pumping apparatus in which the cylinder and piston are formed in an extension of the distributor member. In such a case where the fuel at high pressure is utilized to actuate the piston some spillage of fuel will occur when the spill control valve operates however, as with the example described, the dimensions of the various passages associated with the spill control valve are limited and the spillage of fuel will not be complete. The spill control valve 27 may be in the form of an electromagnetically operable valve such as shown at 40 in FIG. 2 connected between port 28' and port 41 leading to outlet 12. In the case where the initiation of the movement of the piston is effected by fuel derived from an additional pair of plungers, the spillage of fuel in the closed position of the spill valve member will not occur.

We claim:

1. A fuel injection pumping apparatus for supplying fuel to an internal combustion engine comprising:

a pump body;

a bore in said body;

a pumping plunger mounted in said bore for relative movement therein;

a pumping chamber in said body defined by said bore and pumping plunger;

an outlet communicating with said pumping chamber;

cam means operatively engaging said pumping plunger to effect an inward stroke of said plunger in said bore toward said pumping chamber for displacing fuel in said chamber through said outlet;

fuel supply means connectable to said pumping chamber for completely filling said pumping chamber with fuel prior to said inward stroke of said plunger;

a spill valve communicating with said pumping chamber and operable to spill said fuel from said pumping chamber to control the flow of said fuel through said outlet;

an accumulator cylinder having an inlet end connected to said spill valve so that fuel flowing through said spill valve from said pumping chamber enters said cylinder;

a piston movably mounted in said accumulator cylinder for displacement by spilled fuel flowing into said cylinder through said inlet end thereof and for returning said spilled fuel to said pumping chamber prior to the next succeeding inward stroke of said pumping plunger;

biasing means for resiliently urging said piston toward said inlet end of said cylinder; and safety valve means communicating with said inlet end of said cylinder to facilitate escape of fuel from said inlet end of said cylinder in the event that pressure of said fuel in said inlet end of said cylinder increases to a value in excess of the pressure required to displace said piston against the force of said biasing means but less than the pressure required to displace said fuel through said outlet.

2. The fuel injection pumping apparatus as claimed in claim 1 wherein:

said spill valve comprises a valve seat in said body and a valve member disposed on and movable with said piston for engagement with said valve seat in a closed position and disengagement from said valve seat in an open position; and further comprising a spill control valve means for admitting said fuel into said inlet end of said accumulator cylinder from said pumping chamber when required to open said spill valve.

3. The fuel injection pumping apparatus as claimed in claim 2 wherein said spill control valve means comprises:

a port in the wall of said bore communicating with said inlet end of said cylinder; and a helical groove on said pumping plunger communicating with said pumping chamber and connectable with said port when said plunger is in a predetermined position.

4. The fuel injection pumping apparatus as claimed in claim 3 wherein said safety valve means comprises:

a surface on said piston remote and separate from said inlet end of said cylinder;

at least one passage in said piston having one end communicating with said inlet end of said cylinder and another end opening onto said surface on said piston remote and separate from said inlet end of said cylinder; and a safety valve element movably mounted on said piston for displacement between a closed position for closing said another end of said at least one passage and an open position displaced from said another end of said at least one passage, said biasing means resiliently urging said safety valve element toward said closed position of said safety valve element.

5. A fuel injection pumping apparatus as claimed in claim 4 wherein:

said safety valve element comprises a plate member engageable in said closed position thereof with said surface on said piston remote and separate from said inlet end of said cylinder; and said biasing means comprises a spring means.

6. The fuel injection pumping apparatus as claimed in claim 2 wherein said safety valve means comprises:

a surface on said piston remote and separate from said inlet end of said cylinder;

at least one passage in said piston having one end communicating with said inlet end of said cylinder and another end opening onto said surface on said piston remote and separate from said inlet end of said cylinder; and a safety valve element movably mounted on said piston for displacement between a closed position for closing said another end of said at least one passage and an open position displaced from said another end of said at least one passage, said biasing means resiliently urging said safety valve element toward said closed position of said safety valve element.

7. A fuel injection pumping apparatus as claimed in claim 6 wherein:

said safety valve element comprises a plate member engageable in said closed position thereof with said surface on said piston remote and separate from said inlet end of said cylinder; and

8. The fuel injection pumping apparatus as claimed in claim 2 wherein said spill control valve means comprises:

a fluid passage in said body having one end communicating with said pumping chamber;

a second fluid passage having one end communicating with said inlet end of said cylinder; and an electromagnetically operated valve for selectively interconnecting said passages.

9. The fuel injection pumping apparatus as claimed in claim 1 wherein said safety valve means comprises:

a surface on said piston remote and separate from said inlet end of said cylinder;

at least one passage in said piston having one end communicating with said inlet end of said cylinder and another end opening onto said surface on said piston remote and separate from said inlet end of said cylinder; and a safety valve element movably mounted on said piston for displacement between a closed position for closing said another end of said at least one passage and an open position displaced from said another end of said at least one passage, said biasing means resiliently urging said safety valve element toward said closed position of said safety valve element.

10. A fuel injection pumping apparatus as claimed in claim 9 wherein:

said safety valve element comprises a plate member engageable in said closed position thereof with said surface on said piston remote and separate from said inlet end of said cylinder; and said biasing means comprises a spring means.

* * * * *

UNITED STATES PATENT AND TRADEMARK OFFICE
CERTIFICATE OF CORRECTION

PATENT NO. : 5,478,213

DATED : December 26, 1995

INVENTOR(S) : Kenneth M. Harris and Derek W. Tomsett

It is certified that error appears in the above-identified patent and that said Letters Patent is hereby corrected as shown below:

ON THE TITLE PAGE: insert the following: item
[30] Foreign Application Priority Data Sep. 14, 1991 [GB] United Kingdom .....9119690

Signed and Sealed this

Fifteenth Day of April, 1997

*Attest:*

BRUCE LEHMAN

*Attesting Officer*

*Commissioner of Patents and Trademarks*